US008105449B2

(12) United States Patent
Yoshida et al.

(10) Patent No.: US 8,105,449 B2
(45) Date of Patent: Jan. 31, 2012

(54) HIGH-STRENGTH ALUMINUM ALLOY EXTRUDED PRODUCT WITH EXCELLENT IMPACT ABSORPTION AND STRESS CORROSION CRACKING RESISTANCE AND METHOD OF MANUFACTURING THE SAME

(75) Inventors: Arata Yoshida, Toyama (JP); Shinji Makino, Imigu (JP); Tomoo Yoshida, Toyama (JP)

(73) Assignee: Aisin Keikinzoku Co., Ltd. (JP)

( * ) Notice: Subject to any disclaimer, the term of this patent is extended or adjusted under 35 U.S.C. 154(b) by 241 days.

(21) Appl. No.: 11/527,777

(22) Filed: Sep. 26, 2006

(65) Prior Publication Data

US 2007/0074791 A1 Apr. 5, 2007

(30) Foreign Application Priority Data

Sep. 27, 2005 (JP) ..... 2005-278970
Jul. 31, 2006 (JP) ..... 2006-209149

(51) Int. Cl.

| | |
|---|---|
| ***C22F 1/04*** | (2006.01) |
| *C22C 21/06* | (2006.01) |
| *C22C 21/00* | (2006.01) |
| *C22C 21/10* | (2006.01) |

(52) U.S. Cl. ..... 148/690; 148/439; 148/440; 148/550; 420/532; 420/533; 420/540; 420/542

(58) Field of Classification Search ..... 148/437–440, 148/550, 690; 420/528, 529, 532, 533, 540, 420/541, 542

See application file for complete search history.

(56) References Cited

FOREIGN PATENT DOCUMENTS

| | | | |
|---|---|---|---|
| JP | 59-140346 | | 8/1984 |
| JP | 06212338 A | * | 8/1994 |
| JP | 08-144031 | | 6/1996 |
| JP | 09-268342 | | 10/1997 |
| JP | 09-310141 | | 12/1997 |
| JP | 2002-327229 | | 11/2002 |
| JP | 3772962 | | 2/2006 |
| JP | 2006-233336 | | 9/2006 |

OTHER PUBLICATIONS

Ichinose, A., English machine translation of JP 06-212338A, Aug. 1994, entire document.*

* cited by examiner

*Primary Examiner* — Roy King
*Assistant Examiner* — Caitlin Kiechle
(74) *Attorney, Agent, or Firm* — Harness, Dickey & Pierce, P.L.C.

(57) ABSTRACT

An aluminum alloy extruded product includes an aluminum alloy including 6.0 to 7.2 mass % of Zn, 1.0 to 1.6 mass % of Mg, 0.1 to 0.4 mass % of Cu, at least one component selected from the group consisting of Mn, Cr, and Zr in a respective amount of 0.25 mass % or less and a total amount of 0.15 to 0.25 mass %, 0.20 mass % or less of Fe, and 0.10 mass % or less of Si, with the balance substantially being aluminum, the aluminum alloy extruded product having a hollow cross-sectional shape, a recrystallization rate of 20% or less of a cross-sectional area of the extruded product, and a 0.2% proof stress of 370 to 450 MPa.

4 Claims, 12 Drawing Sheets

FIG. 1

| | | Chemical component (%) | | | | | | | | | | Zn/Mg ratio | | ($MgZn_2$) | Excess Mg content | |
|---|---|---|---|---|---|---|---|---|---|---|---|---|---|---|---|---|
| | | Si | Fe | Cu | Mn | Mg | Cr | Zn | Zr | Ti | Al | | | | | |
| Example | 1 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 2 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 3 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 4 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 5 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 6 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 7 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 8 | 0.05 | 0.15 | 0.41 | 0.03 | 1.58 | 0.02 | 7.23 | 0.20 | 0.01 | Balance | 4.58 | ○ | 8.57 | 0.24 | ○ |
| | 9 | 0.05 | 0.16 | 0.11 | 0.02 | 1.07 | 0.02 | 5.95 | 0.11 | 0.01 | Balance | 5.56 | ○ | 7.06 | 0.00 | ○ |
| | 10 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 11 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 12 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 13 | 0.05 | 0.17 | 0.25 | 0.02 | 1.15 | 0.01 | 6.80 | 0.20 | 1.02 | Balance | 5.91 | ○ | 8.06 | 0.00 | ○ |
| | 14 | 0.06 | 0.17 | 0.25 | 0.01 | 1.05 | 0.01 | 6.40 | 0.19 | 2.02 | Balance | 6.10 | ○ | 7.59 | 0.00 | ○ |
| | 15 | 0.06 | 0.16 | 0.25 | 0.01 | 1.25 | 0.02 | 7.00 | 0.19 | 3.02 | Balance | 5.60 | ○ | 8.30 | 0.00 | ○ |
| | 16 | 0.06 | 0.16 | 0.25 | 0.01 | 1.35 | 0.01 | 7.00 | 0.18 | 4.02 | Balance | 5.19 | ○ | 8.30 | 0.05 | ○ |
| | 17 | 0.06 | 0.16 | 0.25 | 0.02 | 1.02 | 0.01 | 6.75 | 0.20 | 5.02 | Balance | 6.62 | ○ | 8.01 | 0.00 | ○ |
| Comparative Example | 1 | 0.05 | 0.17 | 0.08 | 0.00 | 0.95 | 0.00 | 5.81 | 0.05 | 0.02 | Balance | 6.12 | ○ | 6.89 | 0.00 | ○ |
| | 2 | 0.05 | 0.17 | 0.42 | 0.08 | 1.73 | 0.05 | 7.50 | 0.21 | 0.02 | Balance | 4.34 | ○ | 8.90 | 0.34 | ○ |
| | 3 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 4 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 5 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 6 | 0.15 | 0.29 | 0.25 | 0.02 | 1.32 | 0.01 | 6.47 | 0.19 | 0.02 | Balance | 4.90 | ○ | 7.67 | 0.12 | ○ |
| | 7 | 0.06 | 0.17 | 0.25 | 0.00 | 1.38 | 0.00 | 6.49 | 0.05 | 0.02 | Balance | 4.70 | ○ | 7.70 | 0.17 | ○ |
| | 8 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 9 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 10 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 11 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 12 | 0.06 | 0.17 | 0.25 | 0.02 | 1.35 | 0.01 | 6.53 | 0.19 | 0.02 | Balance | 4.84 | ○ | 7.74 | 0.14 | ○ |
| | 13 | 0.05 | 0.17 | 0.25 | 0.01 | 1.80 | 0.01 | 7.50 | 0.19 | 0.02 | Balance | 4.17 | ○ | 8.90 | 0.41 | × |
| | 14 | 0.06 | 0.16 | 0.25 | 0.02 | 1.81 | 0.01 | 5.84 | 0.19 | 0.02 | Balance | 3.23 | ○ | 6.93 | 0.72 | × |
| | 15 | 0.06 | 0.17 | 0.25 | 0.01 | 1.01 | 0.01 | 7.19 | 0.19 | 0.02 | Balance | 7.12 | × | 8.53 | 0.00 | ○ |
| | 16 | 0.05 | 0.17 | 0.43 | 0.01 | 1.15 | 0.01 | 6.71 | 0.01 | 0.02 | Balance | 5.83 | ○ | 7.96 | 0.00 | ○ |
| | 17 | 0.06 | 0.18 | 0.01 | 0.01 | 1.16 | 0.01 | 6.74 | 0.10 | 0.02 | Balance | 5.81 | ○ | 7.99 | 0.00 | ○ |

○: Good ×: Bad

FIG. 2

| | | 11*Cu+45*(Mn+Cr+Zr) | | HOMO holding temperature (°C) | | Extrusion condition: Die temperature (°C) | | Billet temperature (°C) | | Product temperature after extrusion (°C) | | Cooling rate after extrusion (°C/min) | |
|---|---|---|---|---|---|---|---|---|---|---|---|---|---|
| Example | 1 | 12.7 | ○ | 520 | ○ | 460 | ○ | 510 | ○ | 529 | ○ | 62 | ○ |
| | 2 | 12.7 | ○ | 500 | ○ | 460 | ○ | 510 | ○ | 538 | ○ | 62 | ○ |
| | 3 | 12.7 | ○ | 510 | ○ | 460 | ○ | 510 | ○ | 537 | ○ | 62 | ○ |
| | 4 | 12.7 | ○ | 530 | ○ | 460 | ○ | 510 | ○ | 530 | ○ | 62 | ○ |
| | 5 | 12.7 | ○ | 540 | ○ | 460 | ○ | 510 | ○ | 533 | ○ | 62 | ○ |
| | 6 | 12.7 | ○ | 520 | ○ | 460 | ○ | 510 | ○ | 536 | ○ | 31 | ○ |
| | 7 | 12.7 | ○ | 520 | ○ | 460 | ○ | 510 | ○ | 533 | ○ | 82 | ○ |
| | 8 | 15.8 | ○ | 520 | ○ | 460 | ○ | 510 | ○ | 534 | ○ | 62 | ○ |
| | 9 | 8.0 | ○ | 520 | ○ | 460 | ○ | 510 | ○ | 528 | ○ | 62 | ○ |
| | 10 | 12.7 | ○ | 520 | ○ | 460 | ○ | 490 | ○ | 519 | ○ | 62 | ○ |
| | 11 | 12.7 | ○ | 520 | ○ | 460 | ○ | 520 | ○ | 541 | ○ | 62 | ○ |
| | 12 | 12.7 | ○ | 520 | ○ | 460 | ○ | 530 | ○ | 567 | ○ | 62 | ○ |
| | 13 | 13.1 | ○ | 520 | ○ | 460 | ○ | 510 | ○ | 533 | ○ | 62 | ○ |
| | 14 | 12.2 | ○ | 520 | ○ | 460 | ○ | 510 | ○ | 539 | ○ | 62 | ○ |
| | 15 | 12.7 | ○ | 520 | ○ | 460 | ○ | 510 | ○ | 531 | ○ | 62 | ○ |
| | 16 | 11.8 | ○ | 520 | ○ | 460 | ○ | 510 | ○ | 529 | ○ | 62 | ○ |
| | 17 | 13.1 | ○ | 520 | ○ | 460 | ○ | 510 | ○ | 534 | ○ | 62 | ○ |
| Comparative Example | 1 | 3.1 | × | 520 | ○ | 460 | ○ | 510 | ○ | 533 | ○ | 63 | ○ |
| | 2 | 19.9 | ○ | 520 | ○ | 460 | ○ | 510 | ○ | – | – | – | – |
| | 3 | 12.7 | ○ | 480 | × | 460 | ○ | 510 | ○ | 530 | ○ | 62 | ○ |
| | 4 | 12.7 | ○ | 560 | × | – | – | – | – | – | – | – | – |
| | 5 | 12.7 | ○ | 520 | ○ | 460 | ○ | 510 | ○ | 529 | ○ | 25 | × |
| | 6 | 12.7 | ○ | 520 | ○ | 460 | ○ | 510 | ○ | 530 | ○ | 62 | ○ |
| | 7 | 5.0 | × | 520 | ○ | 460 | ○ | 510 | ○ | 539 | ○ | 62 | ○ |
| | 8 | 12.7 | ○ | 520 | ○ | 460 | ○ | 510 | ○ | 537 | ○ | 750 | × |
| | 9 | 12.7 | ○ | 520 | ○ | 460 | ○ | 480 | × | – | – | – | – |
| | 10 | 12.7 | ○ | 520 | ○ | 460 | ○ | 530 | ○ | 585 | × | 62 | ○ |
| | 11 | 12.7 | ○ | 520 | ○ | 460 | ○ | 540 | × | 590 | × | 62 | ○ |
| | 12 | 12.7 | ○ | 520 | ○ | 410 | × | 510 | ○ | – | – | – | – |
| | 13 | 12.2 | ○ | 520 | ○ | 460 | ○ | 510 | ○ | 531 | ○ | 62 | ○ |
| | 14 | 12.7 | ○ | 520 | ○ | 460 | ○ | 510 | ○ | 533 | ○ | 62 | ○ |
| | 15 | 12.2 | ○ | 520 | ○ | 460 | ○ | 510 | ○ | 536 | ○ | 62 | ○ |
| | 16 | 6.1 | × | 520 | ○ | 460 | ○ | 510 | ○ | 532 | ○ | 62 | ○ |
| | 17 | 5.5 | × | 520 | ○ | 460 | ○ | 510 | ○ | 538 | ○ | 62 | ○ |

○: Good ×: Bad

FIG. 3

| | | Mechanical properties | | | | | | Toughness | | SCC | | Extrudability | | | | Overall evaluation |
|---|---|---|---|---|---|---|---|---|---|---|---|---|---|---|---|---|
| | | $\sigma_B$ (N/mm²) | $\sigma_{0.2}$ (N/mm²) | Evaluation | δ (%) | Proof stress after natural ageing 200 hr + T5 (MPa) | | f(E) | | hr | | m/min | | Rectstallization rate (%) | | |
| Example | 1 | 468 | 424 | ○ | 18.3 | – | – | 42.2 | ○ | >168 | ○ | 6.0 | ○ | 2 | ○ | ○ |
| | 2 | 458 | 413 | ○ | 18.2 | – | – | 40.5 | ○ | >168 | ○ | 6.0 | ○ | 2 | ○ | ○ |
| | 3 | 455 | 415 | ○ | 17.8 | – | – | 40.9 | ○ | >168 | ○ | 6.0 | ○ | 2 | ○ | ○ |
| | 4 | 467 | 428 | ○ | 17.5 | – | – | 42.6 | ○ | >168 | ○ | 6.0 | ○ | 2 | ○ | ○ |
| | 5 | 468 | 426 | ○ | 17.1 | – | – | 43.0 | ○ | >168 | ○ | 6.0 | ○ | 2 | ○ | ○ |
| | 6 | 454 | 419 | ○ | 17.9 | – | – | 43.0 | ○ | >168 | ○ | 6.0 | ○ | 2 | ○ | ○ |
| | 7 | 472 | 433 | ○ | 18.0 | – | – | 39.7 | ○ | >168 | ○ | 6.0 | ○ | 2 | ○ | ○ |
| | 8 | 503 | 473 | ○ | 16.3 | – | – | 38.4 | ○ | 125 | ○ | 4.0 | ○ | 1 | ○ | ○ |
| | 9 | 418 | 371 | ○ | 14.3 | – | – | 45.6 | ○ | 78 | ○ | 7.5 | ○ | 18 | ○ | ○ |
| | 10 | 459 | 429 | ○ | 16.8 | – | – | 44.0 | ○ | >168 | ○ | 6.0 | ○ | 2 | ○ | ○ |
| | 11 | 464 | 424 | ○ | 16.1 | – | – | 41.9 | ○ | >168 | ○ | 6.0 | ○ | 2 | ○ | ○ |
| | 12 | 467 | 427 | ○ | 16.4 | – | – | 43.0 | ○ | >168 | ○ | 6.0 | ○ | 2 | ○ | ○ |
| | 13 | 449 | 413 | ○ | 16.2 | 3 | ○ | 44.2 | ○ | >168 | ○ | 6.0 | ○ | 2 | ○ | ○ |
| | 14 | 414 | 374 | ○ | 16.1 | – | – | 41.7 | ○ | >168 | ○ | 6.0 | ○ | 2 | ○ | ○ |
| | 15 | 477 | 437 | ○ | 16.7 | – | – | 44.3 | ○ | >168 | ○ | 6.0 | ○ | 2 | ○ | ○ |
| | 16 | 490 | 451 | ○ | 16.8 | – | – | 45.8 | ○ | >168 | ○ | 6.0 | ○ | 2 | ○ | ○ |
| | 17 | 427 | 391 | ○ | 17.0 | – | – | 45.7 | ○ | >168 | ○ | 6.0 | ○ | 2 | ○ | ○ |
| Comparative Example | 1 | 386 | 341 | × | 13.1 | – | – | 46.8 | ○ | 42 | × | 8.0 | ○ | 46 | × | × |
| | 2 | Could not be extruded | | | | | | | | | | | | | | × |
| | 3 | 458 | 412 | ○ | 17.9 | – | – | 37.6 | × | >168 | ○ | 6.0 | ○ | 2 | ○ | × |
| | 4 | Blistering occurred in billet | | | | | | | | | | | | | | × |
| | 5 | 409 | 368 | × | 15.3 | – | – | 40.5 | ○ | >168 | ○ | 6.0 | ○ | 3 | ○ | × |
| | 6 | 436 | 391 | ○ | 12.1 | – | – | 36.3 | × | >168 | ○ | 5.0 | ○ | 3 | ○ | × |
| | 7 | 438 | 410 | ○ | 10.6 | – | – | 34.2 | × | 8 | × | 6.0 | ○ | 100 | × | × |
| | 8 | 476 | 441 | ○ | 16.3 | – | – | 43.0 | ○ | 24 | × | 6.0 | ○ | 3 | ○ | × |
| | 9 | Could not be extruded | | | | | | | | | | | | | | × |
| | 10 | Poor outward appearance (Pick-up) | | | | | | | | | | | | | | × |
| | 11 | Poor outward appearance (Crack) | | | | | | | | | | | | | | × |
| | 12 | Could not be extruded | | | | | | | | | | | | | | × |
| | 13 | 572 | 542 | ○ | 17.0 | 10 | × | 34.5 | × | 24 | × | 2.0 | × | 2 | ○ | × |
| | 14 | 522 | 486 | ○ | 16.6 | 17 | × | 37.9 | × | 72 | ○ | 2.0 | × | 2 | ○ | × |
| | 15 | 443 | 402 | ○ | 16.8 | – | – | 42.7 | ○ | 48 | × | 6.0 | ○ | 2 | ○ | × |
| | 16 | 445 | 403 | ○ | 16.7 | – | – | 46.8 | ○ | 24 | × | 5.0 | ○ | 100 | × | × |
| | 17 | 439 | 404 | ○ | 16.5 | – | – | 47.8 | ○ | 48 | × | 6.0 | ○ | 17 | ○ | × |

○: Good ×: Bad

FIG. 5A
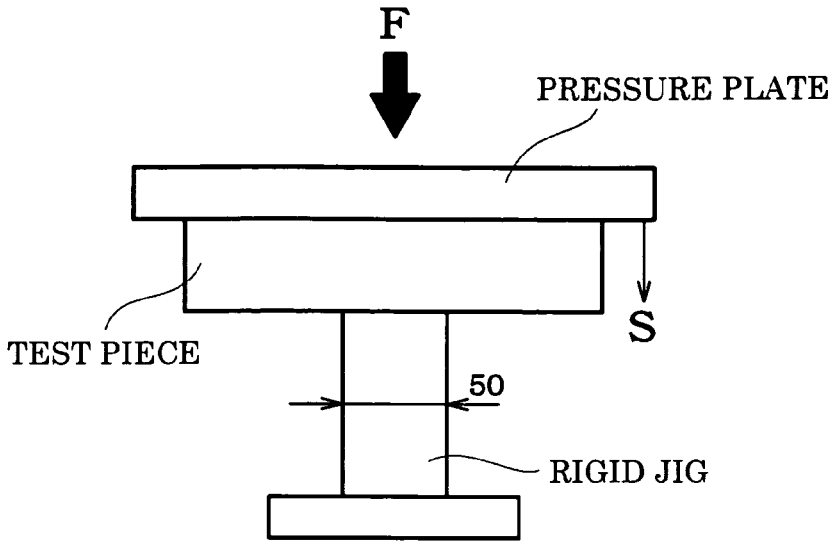
FIG. 5B
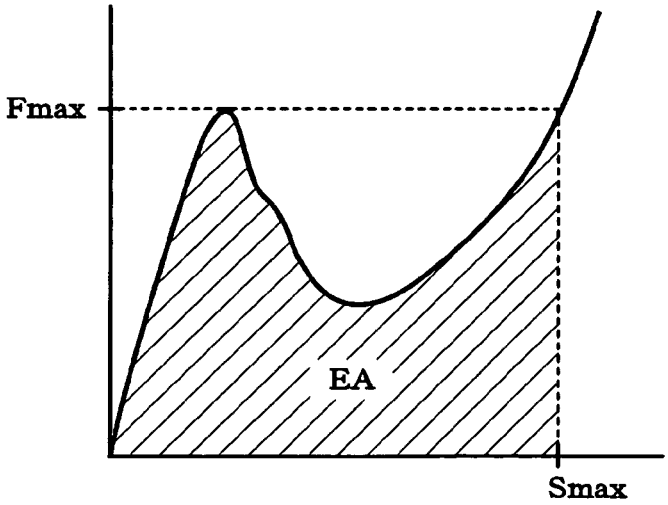
FIG. 5C
$$f(E) = \frac{EA}{Fmax \times Smax} \times 100$$

FIG. 9

| | Chemical component (%) | | | | | | | | | Zn/Mg ratio | Zn*Ng | $MgZn_2$ amount | Excess Zn content | Excess Mg content | Increase due to natural ageing |
|---|---|---|---|---|---|---|---|---|---|---|---|---|---|---|---|
| | Si | Fe | Cu | Mn | Mg | Cr | Zn | Zr | Ti | | | | | | |
| n1 | 0.05 | 0.15 | 0.23 | 0.00 | 1.16 | 0.00 | 6.58 | 0.20 | 0.02 | 5.67 | 7.63 | 7.80 | 0.3 | 0.00 | 0.0 |
| n2 | 0.10 | 0.18 | 0.16 | 0.00 | 1.81 | 0.00 | 5.84 | 0.15 | 0.04 | 3.23 | 10.57 | 6.93 | 0.0 | 0.72 | 16.0 |
| n3 | 0.10 | 0.18 | 0.15 | 0.10 | 1.00 | 0.05 | 6.17 | 0.15 | 0.02 | 6.17 | 6.17 | 7.32 | 0.8 | 0.00 | 3.0 |
| n4 | 0.05 | 0.18 | 0.30 | 0.30 | 1.80 | 0.10 | 7.50 | 0.15 | 0.02 | 4.17 | 13.50 | 8.90 | 0.0 | 0.41 | 8.6 |

HIGH-STRENGTH ALUMINUM ALLOY EXTRUDED PRODUCT WITH EXCELLENT IMPACT ABSORPTION AND STRESS CORROSION CRACKING RESISTANCE AND METHOD OF MANUFACTURING THE SAME

Japanese Patent Application No. 2005-278970 filed on Sep. 27, 2005 and Japanese Patent Application No. 2006-209149 filed on Jul. 31, 2006, are hereby incorporated by reference in their entirety.

BACKGROUND OF THE INVENTION

The present invention relates to an Al—Zn—Mg high-strength aluminum alloy extruded product suitably applied to an impact absorbing structural member such as a bumper reinforcement, a crash box, and a door beam member for vehicles, and a method of manufacturing the same.

An Al—Zn—Mg alloy is known as a high-strength aluminum alloy with excellent extrudability.

A high-strength aluminum alloy extruded product which has been mass-produced and put to practical use has a 0.2% proof stress of about 300 MPa. When further increasing the strength in order to reduce the weight of automobiles, not only extrudability deteriorates, but also breakage tends to occur when impact is applied due to a decrease in toughness. Moreover, since stress corrosion cracking resistance decreases, such an extruded product cannot be applied to an impact absorbing structural member for vehicles.

When increasing the Mg content and the Zn content in order to increase the strength, quench sensitivity after extrusion is increased. This makes it necessary to perform T6 treatment in which the extruded product is subjected to solution treatment and rapidly cooled, thereby resulting in poor productivity.

JP-A-9-310141 discloses an Al—Zn—Mg aluminum alloy extruded product which is a structural material high-strength extruded product designed to provide a specific melt start temperature and subjected to press edge quenching.

The aluminum alloy extruded product disclosed in JP-A-9-310141 aims at ensuring high strength and extrusion productivity. On the other hand, JP-A-9-310141 does not examine the toughness of the aluminum alloy extruded product. The relational expression between the alloy components and the melt start temperature focuses on defects on the surface of the extruded product. Therefore, it is difficult to ensure high toughness.

JP-A-2002-327229 discloses an aluminum alloy extruded product with excellent crushing properties which is suitable for a bumper reinforcement material and the like.

In JP-A-2002-327229, the cooling rate during press quenching is 300° C./min, which is significantly higher than the cooling rate employed for air cooling using a fan.

Since it is difficult to uniformly quench such an aluminum alloy with high quench sensitivity during press quenching, a difference in the degree of cooling occurs between the portion of the material to which cooling air discharged at high speed is directly applied and the remaining portion, whereby distortion in shape such as warping occurs in the extruded product.

In particular, when the extruded product has a hollow cross section, the above distortion in shape such as warping occurs to a large extent due to the heat insulating effect of air in the hollow portion, whereby the product value may not be ensured.

BRIEF SUMMARY OF THE INVENTION

According to a first aspect of the invention, there is provided an aluminum alloy extruded product comprising an aluminum alloy including 6.0 to 7.2 mass % of Zn, 1.0 to 1.6 mass % of Mg, 0.1 to 0.4 mass % of Cu, at least one component selected from the group consisting of Mn, Cr, and Zr in a respective amount of 0.25 mass % or less and a total amount of 0.15 to 0.25 mass %, 0.20 mass % or less of Fe, and 0.10 mass % or less of Si, with the balance substantially being aluminum, the aluminum alloy extruded product having a hollow cross-sectional shape, a recrystallization rate of 20% or less of a cross-sectional area of the extruded product, and a 0.2% proof stress of 370 to 450 MPa.

According to a second aspect of the invention, there is provided a method of manufacturing an aluminum alloy extruded product comprising casting a billet using an aluminum alloy including 6.0 to 7.2 mass % of Zn, 1.0 to 1.6 mass % of Mg, 0.1 to 0.4 mass % of Cu, at least one component selected from the group consisting of Mn, Cr, and Zr in a respective amount of 0.25 mass % or less and a total amount of 0.15 to 0.25 mass %, 0.20 mass % or less of Fe, and 0.10 mass % or less of Si, with the balance substantially being aluminum, homogenizing the cast billet at 500 to 540° C., extruding the homogenized product, and press edge quenching the extruded product at an air cooling rate of 29 to 80° C./min.

BRIEF DESCRIPTION OF THE SEVERAL VIEWS OF THE DRAWING

FIG. 1 shows aluminum alloy components.

FIG. 2 shows the homogenization temperature (HOMO) of a billet and extrusion conditions.

FIG. 3 shows evaluation results of extruded products.

FIGS. 5A, 5B and 5C shows a toughness evaluation method.

FIG. 9 shows chemical components and measurement results of an increase in proof stress after 200 hours of natural ageing.

DETAILED DESCRIPTION OF THE EMBODIMENT

Figure 4:
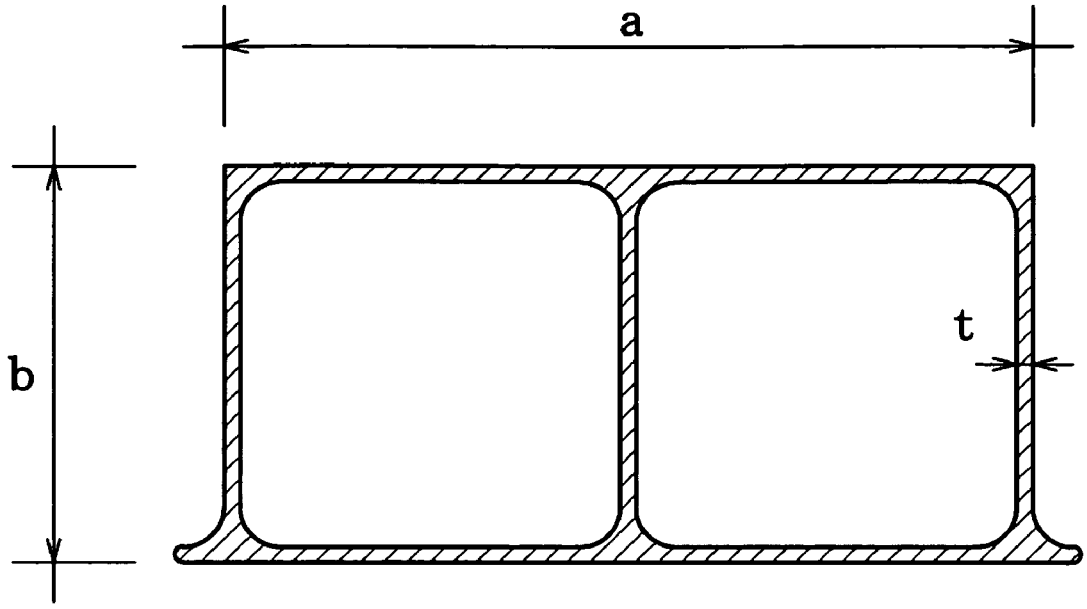
FIG. 4 shows an example of the cross section of an extruded product subjected to evaluation.

In view of the above-described technical problems in the related art, an object of one embodiment of the invention is to provide an aluminum alloy extruded product which exhibits excellent impact absorption, stress corrosion cracking resistance, and extrudability and exhibits high productivity, and a method of manufacturing the same.

In related-art alloy design, an increase in strength tends to cause cracks to occur in the material. In an Al—Zn—Mg alloy, proof stress and toughness are considered to have a strong negative correlation.

The inventors of the invention have conducted extensive studies on the aluminum alloy components and the manufacturing conditions. As a result, the inventors have found that strength is increased by adding specific amounts of Zn and Mg and high toughness (impact absorption) is obtained by controlling the ranges of fiber structure forming components Mn, Cr, and Zr and the homogenization (HOMO) conditions.

In particular, when using an Al—Zn—Mg alloy such as a JIS 7000 series alloy, it has been considered that the homogenization temperature of the billet must be less than 500° C., differing from a JIS 6000 series alloy, since the melting point of Zn is relatively low. On the other hand, the inventors have found that quench sensitivity is reduced by homogenizing the alloy at 500 to 540° C., whereby high strength is obtained by air-cooling press edge quenching after extrusion, and high toughness is also obtained.

An aluminum alloy extruded product according to this embodiment comprises an aluminum alloy including 6.0 to 7.2 mass % of Zn, 1.0 to 1.6 mass % of Mg, 0.1 to 0.4 mass % of Cu, at least one component selected from the group consisting of Mn, Cr, and Zr in a respective amount of 0.25 mass % or less and a total amount of 0.15 to 0.25 mass %, 0.20 mass % or less of Fe, and 0.10 mass % or less of Si, with the balance substantially being aluminum, the aluminum alloy extruded product having a hollow cross-sectional shape, a recrystallization rate of 20% or less of a cross-sectional area of the extruded product, and a 0.2% proof stress of 370 to 450 MPa.

The statement "the balance substantially being aluminum" means that a trace amount of Ti, B, and the like may be contained as impurities within the range of the scope of this embodiment in addition to limiting the Fe content to 0.20 mass % or less and the Si content to 0.1 mass % or less.

An aluminum alloy extruded product is required to exhibit stable impact properties when applied to an impact absorbing structural member such as a bumper reinforcement.

An Al—Zn—Mg alloy is generally subjected to T5 or T6 treatment after extrusion in order to increase the strength. The aluminum alloy extruded product of claim 1 is subjected to T5 treatment so that the 0.2% proof stress is in the range of 370 to 450 MPa.

A vehicle part such as a bumper reinforcement is generally formed by subjecting the extruded product to bending or the like corresponding to the vehicle shape or the like. In this case, the extruded product in a T1 state is subjected to bending or the like after extrusion, and then subjected to T5 treatment.

Therefore, when the T1 proof stress changes after extrusion due to natural ageing, the mechanical properties after T5 treatment may also change. This may result in a decrease in toughness.

In this embodiment, it was found that a positive effect during natural ageing can be reduced by limiting the excess Mg content with respect to the stoichiometric composition of $MgZn_2$ to 0.3 mass % or less. The positive effect means a phenomenon in which a proof stress after the T5 treatment increases more with performing natural ageing after extrusion than without natural ageing.

When applying an aluminum alloy extruded product to vehicle parts, the aluminum alloy extruded product must be bent and assembled into the vehicle body. Therefore, stress corrosion cracking resistance is also an important property.

In this embodiment, it was found that stress corrosion cracking resistance is improved by limiting the Zn/Mg ratio to 6.7 or less or adjusting 11×[Cu content]+45×[total content of Mn+Cr+Zr] to 8.0 or more.

A manufacturing method suitable for the aluminum alloy extruded product according to this embodiment preferably includes casting a billet using an aluminum alloy including 6.0 to 7.2 mass % of Zn, 1.0 to 1.6 mass % of Mg, 0.1 to 0.4 mass % of Cu, at least one component selected from the group consisting of Mn, Cr, and Zr in a respective amount of 0.25 mass % or less and a total amount of 0.15 to 0.25 mass %, 0.20 mass % or less of Fe, and 0.10 mass % or less of Si, with the balance substantially being aluminum, homogenizing the cast billet at 500 to 540° C., extruding the homogenized product, and press edge quenching the extruded product at an air cooling rate of 29 to 80° C./min.

When heating a cylindrical billet to a specific temperature and directly or indirectly extruding the billet using an extrusion press, a high-temperature extruded product is extruded from the extrusion die. The term "press edge quenching" used herein refers to air-cooling the extruded product using a fan or the like to provide quenching effects.

The aluminum alloy components are described below.

Zn: 6.0 to 7.2 mass %

Zn is mainly bonded to Mg to improve proof stress due to precipitation hardening. If the Zn content is less than 6.0 mass %, a proof stress of 370 MPa is not achieved. If the Zn content exceeds 7.2 mass %, stress corrosion cracking resistance and corrosion resistance deteriorate.

Mg: 1.0 to 1.6 mass %

Mg is bonded to Zn to improve proof stress due to precipitation hardening. If the Mg content is less than 1.0 mass %, a proof stress of 370 MPa is not achieved. If the Mg content exceeds 1.6 mass %, extrudability and toughness deteriorate.

Zn and Mg precipitate as a compound, as described above. It is estimated that Zn and Mg form $MgZn_2$ as the stoichiometric composition. When Mg exists in excess to the $MgZn_2$ composition ratio in an amount exceeding 0.3 mass %, Mg exerts a positive effect during natural ageing after extrusion, whereby proof stress increases with time. The increase in proof stress is 5 MPa or more after 200 hours at room temperature.

A variation in mechanical properties after T5 treatment makes it difficult to maintain a stable impact absorption.

The Zn/Mg ratio affects stress corrosion cracking resistance. If the Zn/Mg ratio exceeds 6.7 even if the Zn content is 6.0 to 7.2 mass %, stress corrosion cracking tends to occur although the amount of Mg added is small.

This is considered to be because excess Zn undergoes segregation, whereby the potential difference between the grain boundary and inside the grain is increased.

Note that Zn/Mg=3.75 when the Zn content is 6.0 mass % and the Mg content is 1.6 mass %.

The Zn/Mg ratio is preferably 4.7 or more and 6.7 or less. If the Zn/Mg ratio is less than 4.7, since excess Mg causes distortion of the lattice of the matrix to a large extent, deformation resistance increases, whereby extrudability decreases.

Cu: 0.1 to 0.4 mass % Cu reduces the potential difference between the grain boundary and inside the grain with a small amount of addition, thereby improving stress corrosion cracking resistance. Cu also improves proof stress. If the Cu content is less than 0.1 mass %, the effect is small. If the Cu content exceeds 0.4 mass %, extrudability and corrosion resistance deteriorate.

Mn, Cr, and Zr: 0.25 mass % or less, respectively, and 0.15 to 0.25 mass % in total Mn, Cr, and Zr are bonded to Al to form a minute compound to suppress recrystallization, whereby a fiber structure can be obtained.

Although each of Mn, Cr, and Zr serves as a fiber structure forming element, it is effective to add these elements in combination. In particular, it is preferable to add Zr in an amount greater than those of Mn and Cr, since Zr affects quench sensitivity to only a small extent. It is necessary to control the content of each of these elements to less than the 0.25 mass %. If the total content of these elements is less than 0.15 mass %, the effect is small. If the total content of these elements exceeds 0.25 mass %, quench sensitivity is increased, whereby a sufficient strength cannot be obtained by air cooling. Moreover, the size of the compound is increased, whereby toughness deteriorates.

As described above, the potential difference between the grain boundary and inside the grain is reduced by adding Cu in an amount of 0.1 to 0.4 mass %. Mn, Cr, and Zr reduce the surface recrystallization depth to improve stress corrosion cracking resistance. In order to obtain synergistic effects of these elements, it is preferable to adjust 11×[Cu content]+45×[total content of Mn+Cr+Zr] to 8.0 or more, and preferably 8.5 or more.

Fe: 0.20 mass % or less

Fe, which is an unavoidable impurity, is bonded to Al and Si to form an Al—Fe—Si compound. This compound tends to serve as the starting point of breakage to cause toughness to deteriorate. Therefore, the Fe content is preferably 0.10 mass % or less.

Si: 0.10 mass % or less

Si, which is an unavoidable impurity, is bonded to Al and Fe to form an Al—Fe—Si compound. This compound tends to serve as the starting point of breakage to cause toughness to deteriorate. Therefore, the Si content is preferably 0.05 mass % or less.

Homogenization of Billet

The billet is homogenized in order to eliminate segregation of the main components in the billet such as Mg, Zn, and Cu and to divide and reduce the size of coarse Mn, Cr, Zr, Fe, and Si compounds crystallized during casting to decrease toughness.

The homogenization temperature differs depending on the aluminum alloy components (alloy series). The solution treatment temperature suitable for a 7000 series Al—Zn—Mg alloy has been considered to be 450 to 500° C.

The inventors have found that this temperature range is sufficient to eliminate segregation of the main components, but it is preferable to homogenize the billet at a higher temperature in order to divide and reduce the size of the crystallized products.

Therefore, it was found that toughness and proof stress are improved by homogenization at a high temperature of 500 to 540° C. which has been employed for homogenization of a 6000 series alloy.

In particular, in order to obtain a stable fiber structure after extrusion while controlling the total content of elements which easily undergo segregation, such as Mn, Cr, and Zr, at 0.25 mass % or less, the homogenization temperature of the billet is preferably high, and ideally more than 520° C.

The upper limit is set at 540° C. or less because local melting may occur if the billet is maintained at more than 540° C. for a specific period of time.

If the homogenization temperature is less than 500° C., crystallized products produced during casting the billet are not sufficiently divided and reduced in size, whereby toughness decreases.

Extrusion Conditions

An Al—Zn—Mg high-strength aluminum alloy exhibits poor extrudability in comparison with a 6000 series alloy. Therefore, the extrusion conditions are also important factors.

The heating temperature of the billet is preferably 490 to 530° C. If the heating temperature is less than 490° C., the billet may not be extruded due to high extrusion resistance. If the heating temperature exceeds 530° C., proof stress tends to decrease.

The temperature of the extrusion die is preferably 440 to 500° C. If the temperature of the extrusion die is less than 440° C., the billet may not be extruded due to a decrease in material temperature. If the temperature of the extrusion die exceeds 500° C., the die tends to break during annealing.

The temperature of the extruded product immediately after extrusion is preferably 580° C. or less. If the temperature of the extruded product exceeds 580° C., a Pick-up occurs on the surface of the extruded product, whereby the appearance may deteriorate.

Hollow Cross-Sectional Shape of Extruded Product

The extrudability of an aluminum alloy rapidly decreases accompanying an increase in the strength of the material. When using a known high-strength aluminum alloy with a 0.2% proof stress of 300 MPa or more, only an extruded product with a solid cross section or a simple hollow cross section (single-hollow) can be industrially manufactured.

Figure 6A:
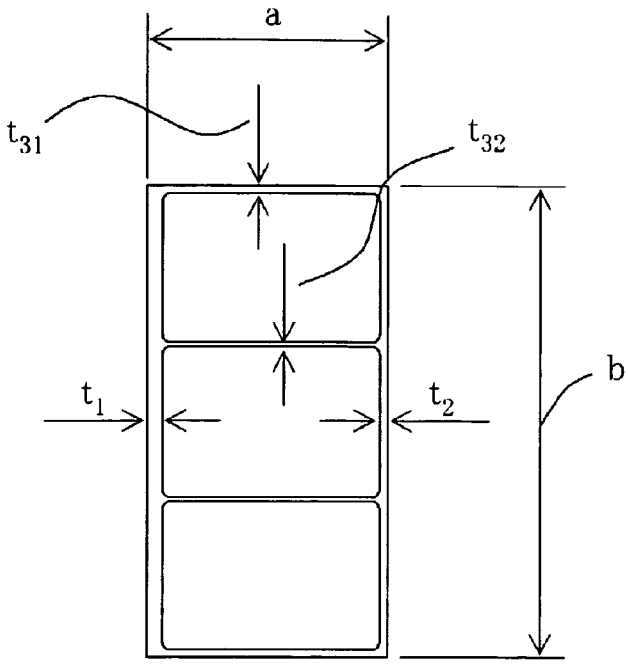
FIGS. 6A and 6B shows an examples of the cross section of a bumper reinforcement using an aluminum alloy extruded product according to the invention.
Figure 6B:
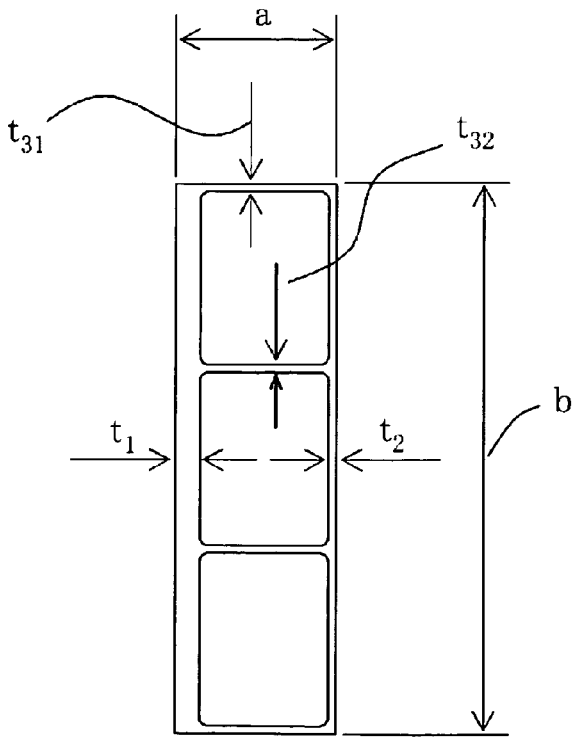

According to this embodiment, a hollow extruded product having a cross-sectional shape with three ribs (double-hollow) shown in FIG. 4 or a cross-sectional shape with four ribs (triple-hollow) shown in FIG. 6 can be industrially manufactured.

The cross-sectional shape shown in FIG. 6(*a*) is the case where the dimension a is 40 mm<a≦75 mm, which can be industrially manufactured when the dimension b is b≦120 mm and the thicknesses of the ribs are $3 \leqq t_1 \leqq 8$, $1 \leqq t_2 \leqq 6$, $1 \leqq t_{31} \leqq 6$, and $1 \leqq t_{32} \leqq 6$.

The cross-sectional shape shown in FIG. 6(*b*) is the case where the dimension a is a≦40 mm, which can be industrially manufactured when the dimension b is b≦140 mm and the thicknesses of the ribs are $3 \leqq t_1 \leqq 8$, $1 \leqq t_2 \leqq 6$, $1 \leqq t_{31} \leqq 6$, and $1 \leqq t_{32} < 6$.

Note that the cross sections in FIG. 6 are schematically illustrated. A vertical rib may be provided outside the outer rib.

According to this embodiment, excellent toughness and extrudability can be ensured in addition to proof stress by setting the Zn content at 6.0 to 7.2 mass %, the Mg content at 1.0 to 1.6 mass %, and the Cu content at 0.1 to 0.4 mass %, and setting the Mg content and the Zn content so that the 0.2% proof stress σ is in the range of 370 to 450 MPa.

Stress corrosion cracking resistance is improved by setting the Zn/Mg ratio at 6.7 or 11×Cu+45×(Mn+Cr+Zr) at 8.0 or more, and natural ageing can be suppressed by limiting the excess Mg content with respect to $MgZn_2$ to 0.3 mass % or less.

In particular, since the total content of the fiber structure forming elements (i.e. Mn, Cr, and Zr) is controlled at 0.15 to 0.25 mass % and the homogenization temperature of the cast billet is set at 500 to 540° C., which is a high temperature for the 7000 series alloy, a stable fiber structure can be formed in the extruded product with a small amount of addition, and quench sensitivity can be reduced, whereby press edge quenching can be performed through relatively mild air cooling at a cooling rate of 29 to 80° C./min so that distortion in shape can be suppressed even when forming an extruded product with a hollow cross section.

Molten metal of each aluminum alloy shown in the table in FIG. 1 was prepared, and cast into a cylindrical billet with a diameter of 204 mm. The billet was homogenized for about 12 hours at a homogenization temperature indicated as the HOMO holding temperature in the table in FIG. 2.

The cooling rate of the billet after homogenization was 100° C./min or more.

An extruded product with a cross-sectional shape (double-hollow) of which a=100 mm, b=50 mm, and thickness t=2 mm, as shown in FIG. 4, was extruded using a 3000-ton hydraulic extrusion press.

The extruded product was air-cooled using a fan immediately after extrusion, and subjected to two-stage artificial ageing (T5) at 95° C. for four hours and at 150° C. for seven hours within 24 hours after air cooling. In Example 13 and Comparative Examples 13 and 14 described later, the proof stress of the material which was allowed to stand at room temperature for 200 hours after air cooling using a fan and subjected to two-stage artificial ageing (T5) was evaluated for comparison.

The cooling rate indicates the average rate until the extruded product was cooled to 100° C. or less.

The examples shown in the tables in FIGS. 1 to 3 correspond to the aluminum alloy extruded products according to this embodiment.

In the tables in FIGS. 1 and 2, the amount of chemical component is indicated by mass %.

The value ($MgZn_2$) indicates the total amount of Mg+Zn when converted to $MgZn_2$ with respect to the Zn content. The value obtained by subtracting the value of Mg+Zn converted to $MgZn_2$ from the value of Mg+Zn in the actual alloy is indicated as the excess Mg content.

11×Cu+45×(Mn+Cr+Zr) indicates 11×[Cu content]+45×[total content of Mn+Cr+Zr].

The table in FIG. 3 shows the evaluation results of the extruded products using the aluminum alloy billets shown in the table in FIG. 1.

Examples 1 to 17 indicate the extruded products and the manufacturing condition examples according to this embodiment, and Comparative Examples 1 to 17 indicate the following cases.

In Comparative Example 1, the Mg content, the Zn content, and the total content of Mn, Cr, and Zr are lower than the lower limits.

In Comparative Example 2, since the Mg content and the Zn content are higher than the upper limits, the billet could not be extruded.

In Comparative Example 3, the homogenization temperature (HOMO temperature) of the billet is lower than the lower limit.

In Comparative Example 4, since the billet was maintained for 12 hours at 560° C. exceeding the upper limit of the homogenization temperature of the billet, blistering occurred in the billet. Therefore, the billet was not extruded.

In Comparative Example 5, the press edge quenching speed is lower than the lower limit.

In Comparative Example 6, the Si content and the Fe content are higher than the upper limits.

In Comparative Example 7, the total content of Mn, Cr, and Zr is lower than the lower limit.

In Comparative Example 8, the extruded product was subjected to T6 treatment by water quenching.

In Comparative Example 9, since the billet temperature (480° C.) was lower than 490° C., the billet could not be extruded.

In Comparative Example 10, since the surface temperature (585° C.) of the extruded product immediately after extrusion was higher than 580° C., pickup defects occurred on the surface of the material.

In Comparative Example 11, since the billet temperature (540° C.) was higher than 530° C., the temperature of the extruded product after extrusion increased to 590° C., whereby a "Crack" outward appearance occurred.

In Comparative Example 12, since the die temperature (410° C.) was lower than 440° C., the billet could not be extruded.

In Comparative Example 13, since the Mg content was 1.80 and the Zn content (7.50) was higher than 7.2, the excess Mg content (0.41) exceeded 0.3. As a result, while the proof stress after T5 treatment within 24 hours after air cooling was 542 MPa, the proof stress after T5 treatment after being allowed to stand for 200 hours after extrusion increased to 552 MPa. That is, the proof stress increased by 10 MPa.

Since the proof stress (542 MPa) after T5 treatment within 24 hours after air cooling was higher than 450 MPa, toughness decreased.

Moreover, extrudability decreased due to a decrease in toughness.

In Comparative Example 14, since the Mg content was 1.81 and the Zn content was 5.84, the excess Mg content was 0.72. As a result, an increase in proof stress due to T5 treatment by natural ageing (room temperature×200 hours) was as high as 17 MPa. Since the proof stress after T5 treatment within 24 hours after air cooling was high, toughness decreased.

Moreover, extrudability decreased due to a decrease in toughness.

In Comparative Example 15, since the Zn/Mg ratio (7.12) exceeded 6.7, stress corrosion cracking resistance (SCC) decreased to a small extent.

In Comparative Examples 16 and 17, since 11×Cu+45×(Mn+Cr+Zr) was less than 8.0, stress corrosion cracking resistance (SCC) decreased. Moreover, the recrystallization rate increased.

As the evaluation method for the mechanical properties, a 0.2% proof stress (σ0.2) of 370 MPa or more was indicated as "Good", and an extrudability of 4 m/min or more was indicated as "Good".

Toughness was determined as follows. As schematically shown in FIG. 5, an extruded product test piece was placed between a rigid jig (width: 50 mm, length: 150 mm or more) and a pressure plate so that the inner rib was parallel to the buckling direction, and subjected to a buckling test. The f(E) value was calculated from the load F and the displacement S based on the energy absorption EA using the expression shown in FIG. 5(*c*).

The f(E) value becomes higher as the number of cracks in the extruded product becomes smaller and the toughness becomes higher. An f(E) value of 38 or more was indicated as "Good".

Stress corrosion cracking resistance (SCC) was evaluated as follows. A test piece to which stress corresponding to the proof stress was applied was immersed in a 50° C. aqueous solution of 36 g/L of chromium oxide, 30 g/L of potassium dichromate, and 3 g/L of sodium chloride. The period of time until cracks occurred was measured. A case where cracks occurred after 72 hours or more was indicated as "Good".

The recrystallization rate was determined by measuring the area ratio of the recrystallized portion after polishing the cross section of the extruded product. A recrystallization rate of 20% or less was indicated as "Good".

Figure 12:
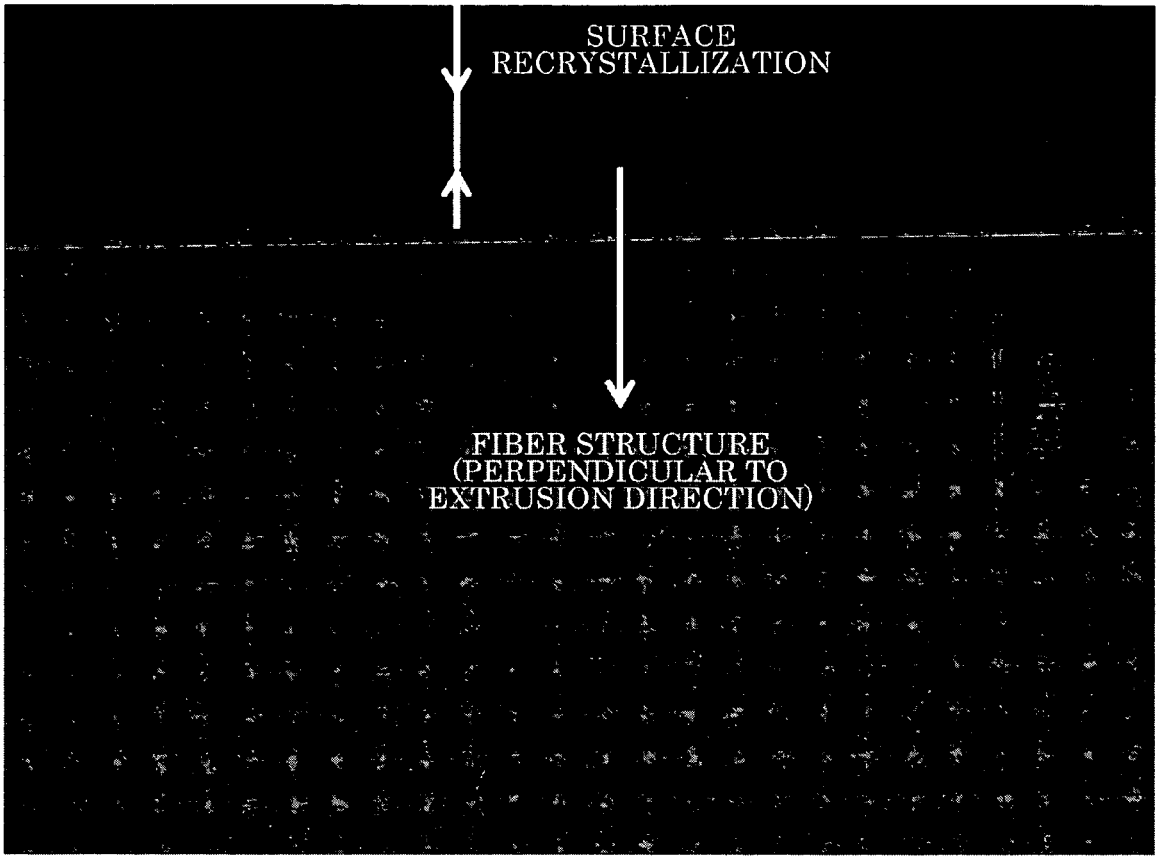
FIG. 12 shows an example of a micrograph of the cross section of an extruded product according to the invention.

FIG. 12 shows an example of a photograph of the cross section of the extruded product according to this embodiment.

A reduction in the positive effect of natural ageing was evaluated by determining the increase in the proof stress of the material subjected to artificial ageing after being allowed to stand for 200 hours at room temperature with respect to the proof stress of the material subjected to artificial ageing within 24 hours after extrusion and air cooling. An increase in proof stress of 5 MPa or less was indicated as "Good".

An excess Mg content of 0.3 or less was indicated as "Good". A 11×Cu+45×(Mn+Cr+Zr) value of 8.0 or more was indicated as "Good".

From the results shown in the tables in FIGS. 1 to 3, it was found that excellent proof stress, toughness, and stress corrosion cracking resistance are obtained by air-cooling press edge quenching and two-stage artificial ageing by setting the homogenization temperature at a high temperature of 500 to 540° C.

Figure 7:
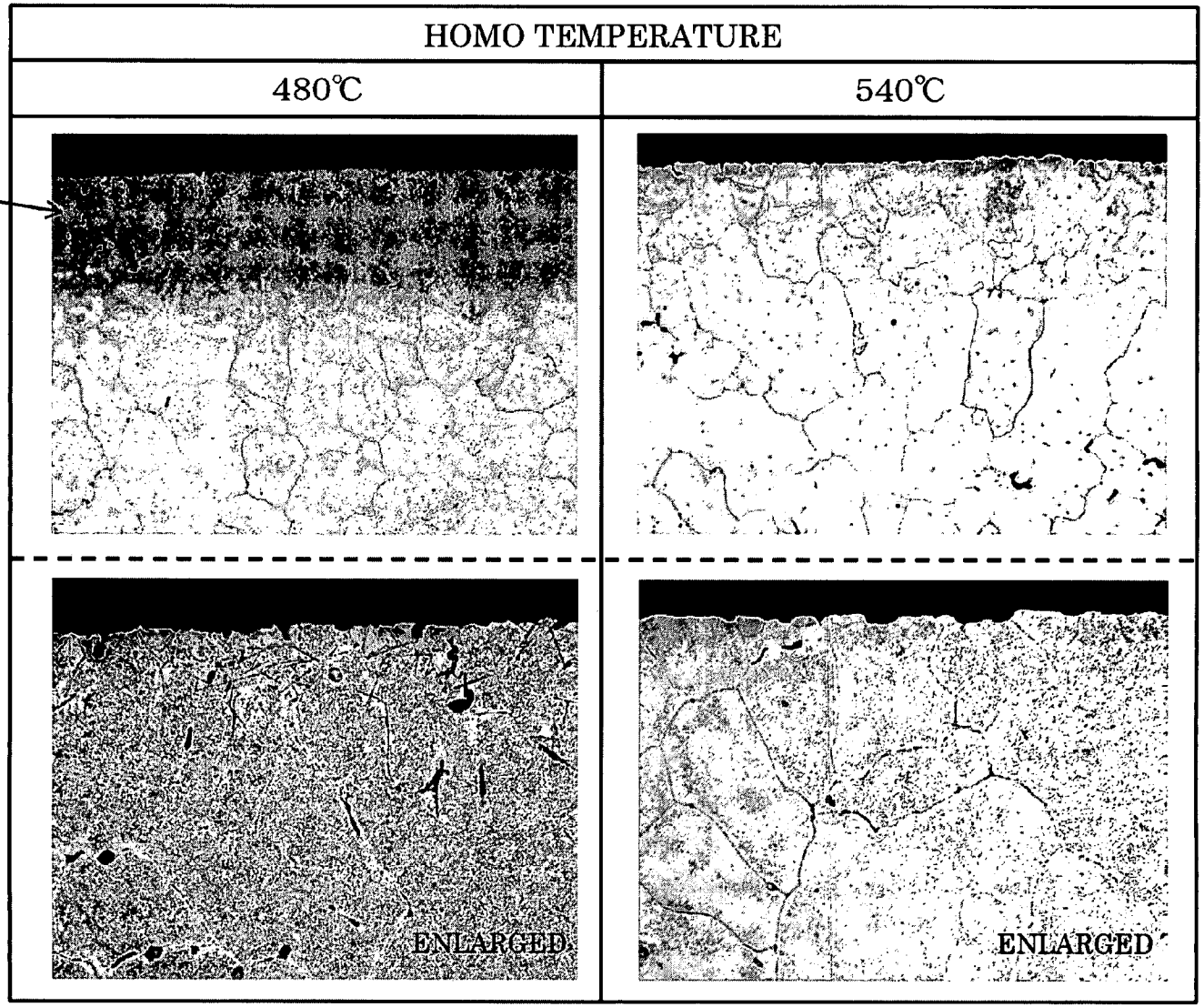
FIG. 7 shows the homogenization temperature of a billet and texture photograph examples.

FIG. 7 shows a photograph of the texture of the billet using an optical microscope (upper side: ×100, lower side: ×400). When the HOMO temperature is 480° C., a number of segregates are observed around the chill layer (thickness of about 1 to 2 mm from the surface). When the HOMO temperature is 540° C., the size of precipitates is reduced.

A more detailed examination is given below.

The extruded product of Comparative Example 8 is a T6 temper material subjected to solution treatment and water quenching after extrusion.

When the material is subjected to T6 treatment, a high proof stress and a relatively high f(E) value are achieved. On the other hand, stress corrosion cracking resistance (SCC) is as poor as 24 hours.

The reason therefor is considered to be as follows. Specifically, since the precipitation free zone (PFZ) becomes narrow when performing T6 treatment at a high quenching speed, proof stress and toughness are relatively increased. On the other hand, since stress is concentrated in the PFZ portion, stress corrosion cracking resistance (SCC) is decreased.

When comparing Examples 1 to 5, the f(E) value tends to become higher as the homogenization temperature (HOMO temperature) of the billet becomes higher.

The reason therefor is considered to be as follows. Specifically, even if the recrystallization rate is almost the same, if the homogenization temperature is low, crystallized products of intermetallic compounds with Si, Fe, Mn, Zr, Cr, Al, and the like produced during casting are not sufficiently divided.

Therefore, in order to improve the property values which have been considered to have a strong negative correlation, such as proof stress, toughness, and stress corrosion cracking resistance, it was found that it is effective to set the homogenization temperature of the billet at a high temperature of 500 to 540° C. which has not been employed for the 7000 series alloy and to subject the extruded product to air-cooling press edge quenching at a relatively low cooling rate of 29 to 80° C./min.

From Examples 10 to 17 and Comparative Example 15, it was found that stress corrosion cracking resistance (SCC) is improved at a Zn/Mg ratio of 6.7 or less.

Figure 8:
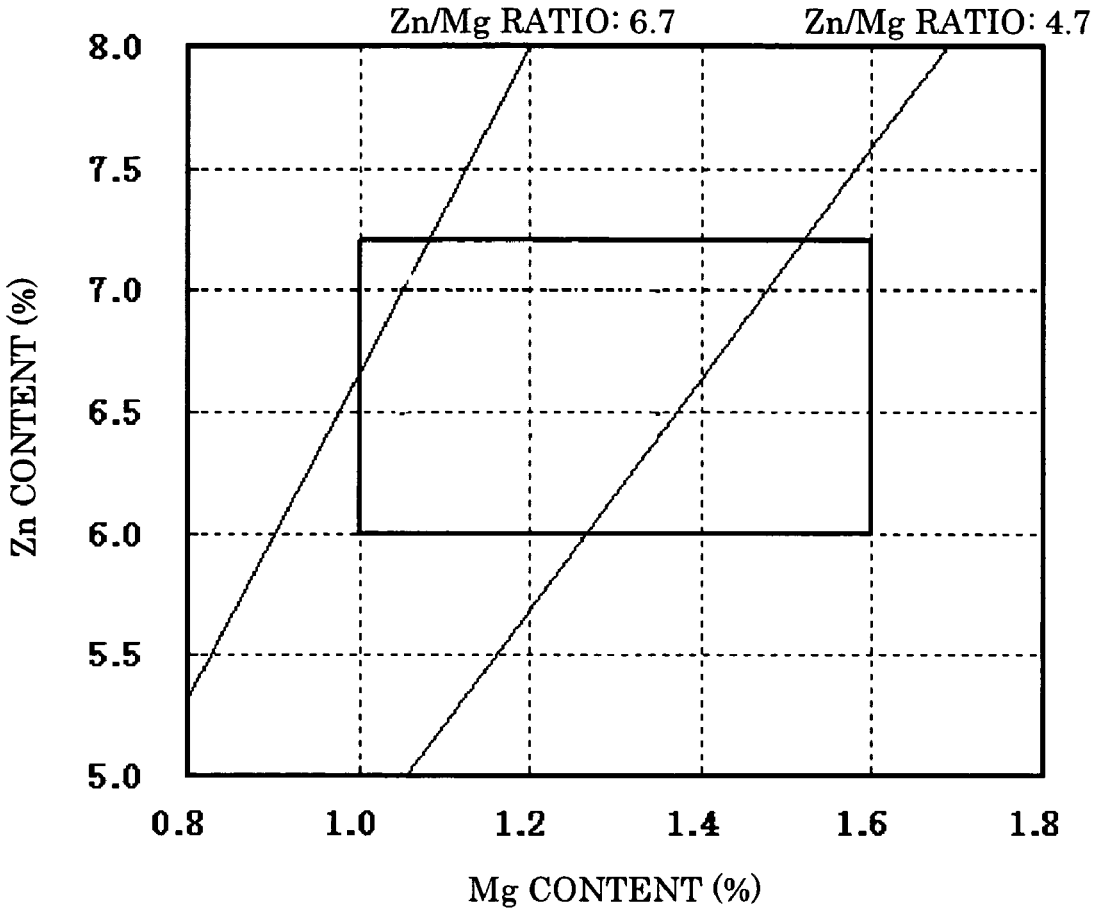
FIG. 8 shows the relationship among the Zn content, the Mg content, and the Zn/Mg ratio.

FIG. 8 shows the relationship among the Zn content, the Mg content, and the Zn/Mg ratio.

Figure 11:
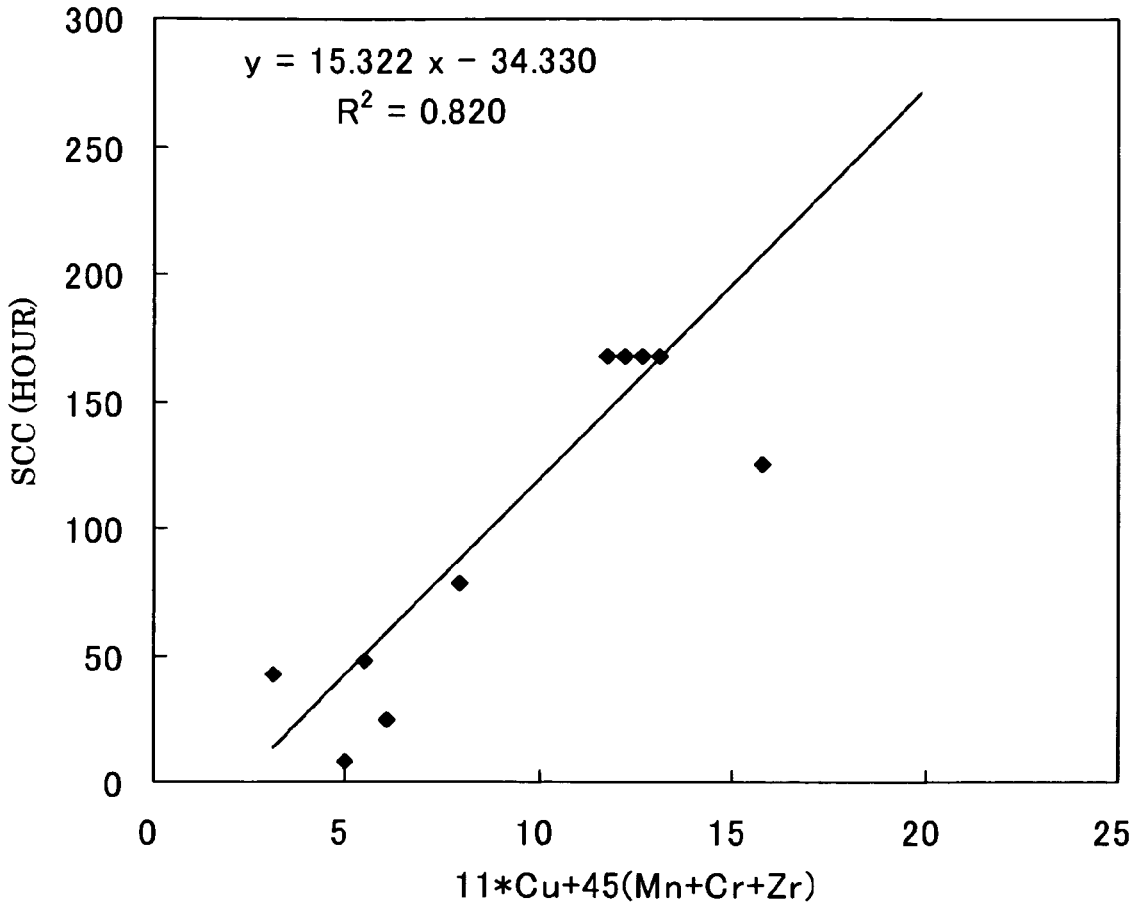
FIG. 11 shows linear regression analysis results of SCC and 11×Cu+45×(Mn+Cr+Zr).

From Examples 10 to 17 and Comparative Examples 16 and 17, it was found that excellent stress corrosion cracking resistance (SCC) is achieved at 11×Cu+45×(Mn+Cr+Zr) of 8.0 or more. The graph in FIG. 11 shows the simple linear regression analysis results in order to verify the above finding (Examples 1 to 17 and Comparative Examples 1, 7, 16, and 17).

This is because the potential difference between the crystal grain boundary and inside the grain is reduced by adding Cu, and stress corrosion cracking resistance (SCC) is improved by reducing the surface recrystallization depth using Mn, Cr, and Zr.

The statistic examination results of the relationship between the excess Mg content and an increase in proof stress due to natural ageing are described below with reference to FIGS. 9 and 10.

Aluminum alloys $n_1$ to $n_4$ containing the chemical components shown in FIG. 9 were prepared. An increase in the proof stress of the material subjected to artificial ageing after 200 hours of natural ageing with respect to the proof stress of the material subjected to artificial ageing within 24 hours after extrusion and air cooling using a fan was measured. The graph in FIG. 10 shows the simple linear regression analysis results.

From these results, it was found that the excess Mg content and the increase in proof stress have a strong positive correlation.

Figure 10:
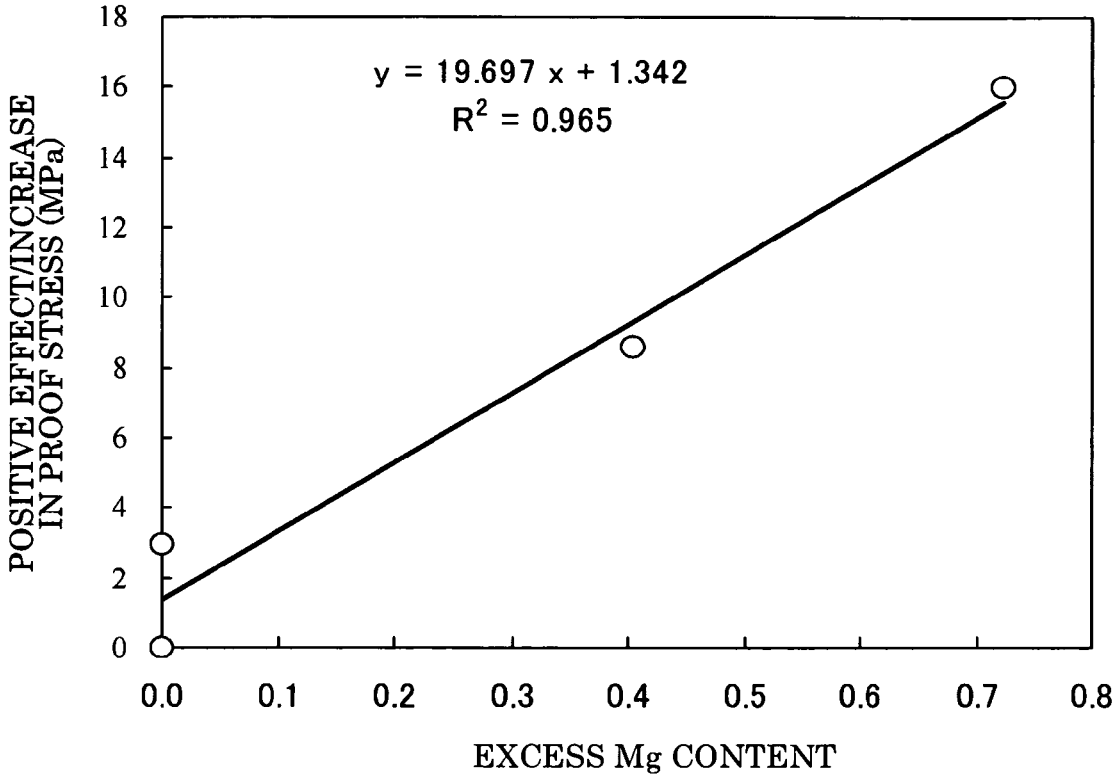
FIG. 10 shows the relationship between excess Mg and a positive effect.

From Example 13, Comparative Examples 13 and 14, and the results shown in FIG. 10, the excess Mg content is preferably 0.3 mass % or less.

The extruded product with a cross-sectional shape (triple-hollow) shown in FIG. 6 was also evaluated. As a result, mechanical properties, stress corrosion cracking resistance (SCC), and extrudability were the same as those of the cross-sectional shape (double-hollow) shown in FIG. 4, and toughness was higher than that of the cross-sectional shape (double-hollow) shown in FIG. 4.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A method of manufacturing an aluminum alloy extruded product comprising:

casting a billet using an aluminum alloy including 6.40 to 7.2 mass % of Zn, 1.0 to 1.6 mass % of Mg, 0.1 to 0.4 mass % of Cu, 0.01 to 0.03 mass % of Mn, 0.01 to 0.02 mass % of Cr, 0.18 to 0.20 mass % of Zr, 0.20 to 0.25 mass % of a total amount of Mn, Cr and Zr, 0.20 mass % or less of Fe, and 0.10 mass % or less of Si, excess Mg content with respect to stoichiometric composition of $MgZn_2$ being 0.3 mass % or less, 11×(Cu content)+45×(total content of Mn+Cr+Zr) being more than 8.0, with the balance substantially being aluminum;

homogenizing the cast billet at 520° C. to 540° C.;

extruding the homogenized product;

press edge quenching the extruded product at an air cooling rate of 29 to 80° C./min;

natural aging the extruded product at room temperature; and artificial aging the extruded product, an increase in proof stress of the extruded product subjected to the artificial aging after a time period of within 24 hours of the natural aging being 5 MPa or less with respect to the proof stress of the extruded product subjected to the artificial aging after 200 hours of the natural aging, and an extension of the extruded product being more than 16.1 to 18.3%.

2. The method of manufacturing an aluminum alloy extruded product of claim 1 wherein the extension of the extruded product is 17.1 to 18.3%.

3. The method of manufacturing an aluminum alloy extruded product of claim 1 wherein a ratio of Mg/Zn is 5.19≦Mg/Zn≦6.62.

4. The method of manufacturing an aluminum alloy extruded product of claim 1 wherein:

the extension of the extruded product is 17.1 to 18.3%; and a ratio of Mg/Zn is 5.19≦Mg/Zn≦6.62.

* * * * *